United States Patent [19]

Drosky

[11] Patent Number: 4,527,450

[45] Date of Patent: Jul. 9, 1985

[54] STOPPER EXTRACTOR

[76] Inventor: Billy J. Drosky, 719 Circle Ct., San Francisco, Calif. 94080

[21] Appl. No.: 549,108

[22] Filed: Nov. 7, 1983

[51] Int. Cl.[3] ..... B67B 7/00

[52] U.S. Cl. ..... 81/3.29; 81/3.31; 81/3.37; 81/3.08; 81/3.56

[58] Field of Search ..... 81/3.38 R, 3.31, 3.46 R, 81/3.1 B, 3.37

[56] References Cited

U.S. PATENT DOCUMENTS

| | | | |
|---|---|---|---|
| 34,216 | 1/1862 | Russel | 81/3.37 |
| 1,787,018 | 12/1930 | Porz | 81/3.38 R |
| 2,548,697 | 4/1951 | Belpedio et al. | 81/3.46 |
| 2,761,338 | 9/1956 | Hardy | 81/3.38 |
| 4,406,182 | 9/1983 | Antone | 81/3.38 R |

FOREIGN PATENT DOCUMENTS

| | | | |
|---|---|---|---|
| 52387 | 1/1911 | Switzerland | 81/3.37 |

*Primary Examiner*—Frederick R. Schmidt
*Assistant Examiner*—J. T. Zatarga
*Attorney, Agent, or Firm*—Townsend and Townsend

[57] ABSTRACT

A stopper extractor includes a housing having an open end and a closed end and a side-facing cutout on one side of the housing wall with a grip disposed for axial movement within the housing. The grip has an inwardly disposed circular flange, a side-facing cutout and an axial extension which passes through the closed housing end. The side-facing cutouts are sized to allow the enlarged head of a stopper to be inserted laterally into the grip. A crescent shaped cam is pivotally mounted to the extension and bears against the outer surface of the closed end. A handle is used to pivot the cam which pulls the grip axially upwardly. A spring, between the grip and the housing, biases the grip axially toward the open housing end. The extractor is mounted over the stopper with the open end against the container and the grip lip under the lower edge of the cork head. Rocking the handle pivots the cam to raise the grip. This causes the open end to bear downwardly against the container and the grip to move axially upwardly within the housing to pull the cork from the container and into the housing.

2 Claims, 5 Drawing Figures

STOPPER EXTRACTOR

BACKGROUND OF THE INVENTION

Most people have difficulty in removing the closure of a container filled with carbonated beverage or sparkling wine. In this application such beverages will often be referred to collectively as champagne and their closures as a cork or stopper. However, the invention is not limited by such nomenclature. Various devices have been offered to make the job of extracting the champagne cork convenient, although none of these devices has been entirely successful in making the task easier or safer. Devices for removing champagne corks have included a plier-like device which grips the free end or head of the cork. To operate this device one must apply force from the plier-like handle located on a horizontal plane with the cork. Accordingly, a great amount of force is needed to raise the cork vertically from the bottle because the force is not applied axially from above the cork.

Another device contains a grip that engages both the upper and lower surfaces of the head of a champagne cork with a hook and angular flanges. This device is operated by gripping the bottle neck with one hand and turning a cork extractor crank with the other hand in a circular motion. This cranking motion appears to require the expenditure of a great deal of time and energy to exert the necessary vertical force to raise a cork from its bottle. Still another device uses bifurcated jaws engageable about the neck of a bottle between the shoulder and the mouth of a bottle for engagement of the upper jaw below the head of a stopper; spreading the jaws forces the stopper upward against a retaining arm. The handle of this device extends horizontally from the head of the cork to be removed. To remove the cork, the jaws of the device are spread by manipulating the handles, operated from one side of the bottle. Devices such as described above include those shown in U.S. Pat. Nos. 3,722,327; 3,800,345; and 4,018,110. None of the prior art devices shown approaches the present invention in simplicity, ease of operation, and safety.

SUMMARY OF THE INVENTION

The stopper extractor of the present invention comprises a housing having a lower, open end and an upper, closed end and an arch-shaped opening on one side of the housing wall. The open end includes a side-facing opening and has a lower lip configured to engage the container immediately below the head of a stopper. A grip, configured to engage the cork or stopper, is disposed for axial movement within the housing. The grip has an axial extension, which passes through an opening in the closed, upper end of the housing, an inwardly disposed circular lip and a side-facing opening through which the stopper is inserted.

A crescent shaped cam is pivotally mounted to the upper end of the grip extension, which extends above the closed housing end. The cam bears against the outer surface of the closed end. A handle is connected to the cam and is used to actuate the cam from a grip lowered position to a grip raised position to pull the grip extension axially upwardly. Pivotal movement of the handle is restricted to movement in a vertical plane along an arcuate path on one side of the longitudinal axis of the housing by a limit pin which extends through the cam. This path is opposite the side-facing housing opening to help keep the extractor properly engaged with the container during use. A spring is disposed between the grip and the housing for biasing the grip axially toward the open end of the housing.

The extractor is mounted over the cork head with the lower housing lip against the container and the grip lip under the lower edge of the cork head. Rocking the handle from the grip lowered to the grip raised positions pivots the cam to raise the grip extension. The raising of the grip causes the lower lip of the open end to bear downwardly against the container and the grip to move axially upwardly within the housing to pull the cork from the container. Raising the cork moves it above the side-facing housing opening to capture it within the housing. Therefore, the force exerted on the cork is substantially purely vertical which affords the user maximum mechanical advantage since lateral forces, tending to push the stopper against the container, are minimized.

The housing captures the cork once it is removed from the container. Therefore, the cork extractor lends safety to the procedure of removing a cork because it prevents the cork from becoming a projectile propelled by the rapid expulsion of carbon dioxide gas from the container. The use of the present invention can thus reduce personal injuries, including the loss of an eye, or damage to property caused by flying corks.

The scope of the invention encompasses the removal of any stopper with a head protruding from its container. The stopper may be made of natural cork, plastic, or any other material. The cork extractor is simple in construction and operation; only a few simple steps are needed to operate the extractor and remove a stopper from its container.

DETAILED DESCRIPTION OF THE PREFERRED EMBODIMENT

Figure 1:
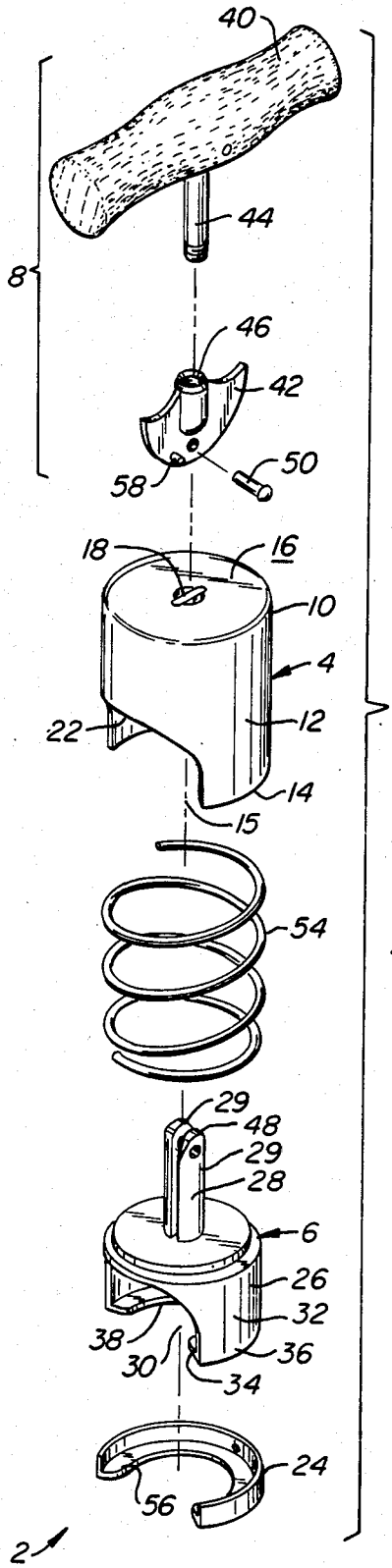
FIG. 1 is an exploded perspective view of the stopper extractor and its component parts.

Turning now to FIG. 1, stopper extractor 2 includes broadly a generally cylindrical housing 4, a grip 6 contained within the housing and a puller assembly 8 operably connected to the grip and located above the upper end 10 of housing 4.

Housing 4 includes a circular side wall 12, terminating in a lower edge 14 at a lower end 15, and at upper end 10. A central opening 18 is formed within a closed, upper surface 16. A side-facing opening or cutout 22 is formed in side wall 12 and is sized to allow an enlarged head H of a stopper S to be inserted laterally through the cutout as suggested in FIG. 2A. An edge guard 24 is mounted to lower edge 14 and provides a suitable interface between housing 4 and a rolled lip L on bottle B.

Grip 6 includes a lower, generally cylindrical body 26 and an upper, axial extension 28. Extension 28 includes a pair of spaced-apart fingers 29. Grip 6 is sized to fit within the interior of housing 4 and includes a side-facing opening or cutout 30 in a side wall 32 of body 26 and an inwardly extending lip 34 at a lower edge 36 of side wall 32. Cutout 30 is similar to cutout 22 in its shape and size to allow head H of a stopper S to be housed within the interior 38 of grip 6 with lip 34 positioned beneath a lower edge E of head H. A spring 54 is captured between grip 6 and upper end 10 of housing 4 and biases grip 6 towards an inwardly extending lip 56 of edge guard 24, that is toward the grip lowered position of FIGS. 2A and 2B.

Pulling assembly 8 includes a handle 40 and an arcuate cam 42. A shank 44 of handle 44 threadably engages a complementary hole 46 formed in cam 42. Cam 42 is pivotally secured between parallel fingers 29 at the upper ends 48 of fingers 29 by a pin 50. Movement of handle 40 in the direction of arrow 52 toward the grip raised position of FIG. 2C, as indicated in FIGS. 2B and 2C, causes cam 48 to lift upper ends 48 of fingers 29 above upper surface 16 of housing 4. Pivotal movement of handle 40 in the direction opposite arrow 52 past the upright, grip lowered position of FIG. 2B is prevented by a limit pin 58 extending through cam 42. Limit pin 58 thus contacts upper end 48 of extension 28 when handle 40 is in its upright position and grip 6 is biased fully downwardly with lip 34 adjacent lip 56.

Figure 2A:
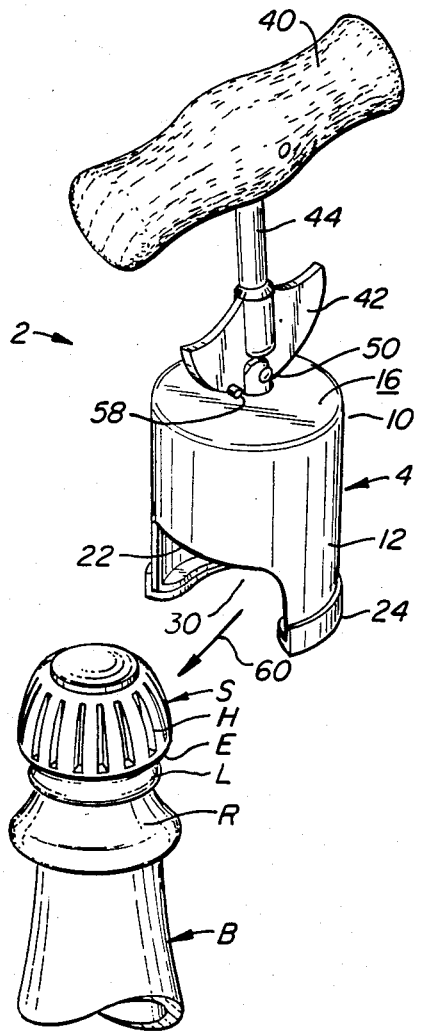
FIG. 2A shows the stopper extractor prior to gripping the stopper in a container.
Figure 2D:
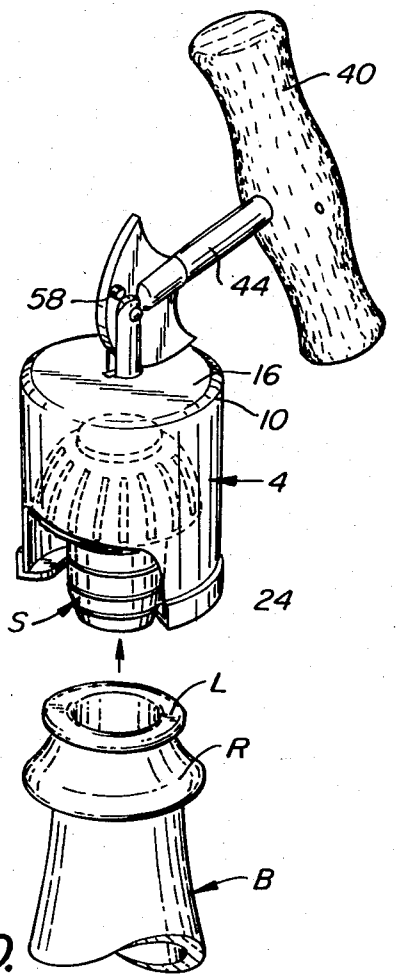
FIG. 2D shows the stopper captured within the housing of the stopper extractor after the stopper is removed from its container.

In use, the user mounts extractor 2 to stopper S by moving extractor 2 laterally in the direction of an arrow 60 shown in FIG. 2A so that lips 34, 56 slide between edge E and neck ring R so head H becomes housed within interior 38 of grip 6. With stopper extractor 2 positioned over enlarged head H of stopper S, as shown in FIG. 2B, the longitudinal axis 62 of housing 4 forms an extension of the longitudinal axis 64 of bottle B. Lip 56 of housing 4 is pressed against ring R of bottle B and lip 34 is engaged under head H of stopper S. The user then moves handle 40 in the direction of arrow 52 in FIG. 2B.

Figure 2C:
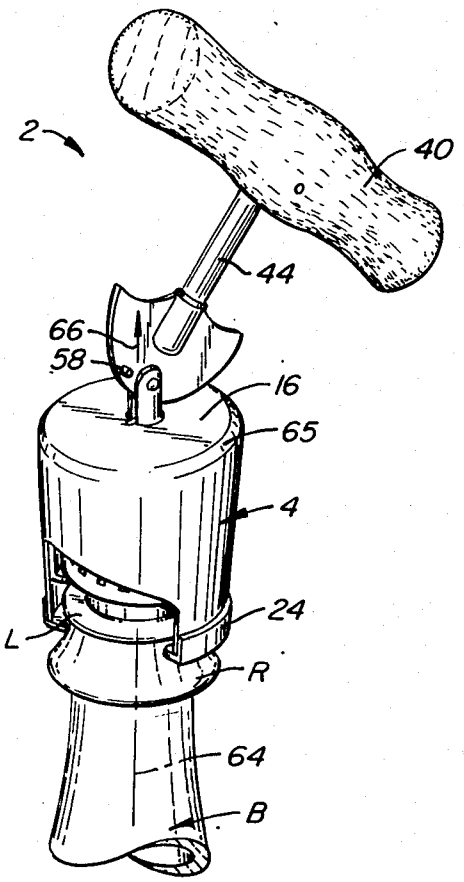
FIG. 2C shows the stopper extractor of FIG. 2B with the handle and cam moved from the grip lowered position in FIG. 2B and in the process of pulling the stopper from the container.
Figure 2B:
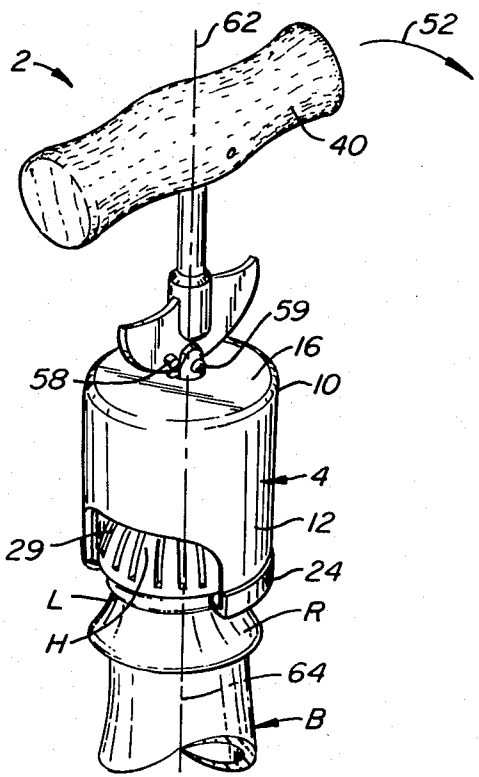
FIG. 2B shows the stopper extractor mounted about the stopper.

When handle 40 is moved, cam 42 pivots about pin 50 and pin 50 moves upwardly in the direction of an arrow 56, as shown in FIG. 2C. Thus, the rotation of cam 42 causes grip 6 to rise axially within housing 4 so that lip 34 and lip 56 separate. This permits the user to fully utilize the significant mechanical advantage of the cam and handle in pulling stopper S from bottle B. As handle 40 is moved and cam 42 rotated, stopper S is pulled from bottle B and captured within housing 4. As can be seen from FIGS. 2C and 2D, raising stopper S pulls the stopper head H into the interior of housing 4 above cutout 22 to prevent runaway corks from endangering people and property.

The method of extracting stopper S from bottle B comprises the steps of holding housing 4 adjacent bottle B as shown in FIG. 2A, with open lower end 15 facing downward, holding bottle B, sliding lip 56 and lip 34 between edge E of head H and rolled lip L of bottle B, as shown in FIG. 2B. Handle 40 is then moved in a vertical plane in the direction of arrow 52 in FIG. 2B. The movement of handle 40 causes cam 42 to rotate about pin 50 which raises grip 6 and separates grip lip 34 from housing lip 56. Stopper S is thereby pulled from bottle B and captured within housing 4 independent of bottle B. Stopper extractor 2 is then removed from bottle B.

The embodiment disclosed above is capable of simple, easy, safe extraction of a stopper from a container. The stopper extractor is easily manufactured at low cost and may be suitable for use as a gift or as a standard supply item at bars and restaurants. While it is most likely that the stopper extractor will be useful for removing stoppers of cork, plastic, or other material from a bottle of champagne or other sparkling wine, the extractor is also useful for removal of any stopper with an enlarged head protruding from its container.

The embodiment described is illustrative of the principles of the invention. Modifications will occur to those skilled in the art without departing from the spirit or scope of the invention as defined in the following claims. For example, the housing of the extractor may be cubic in shape if desired. The extractor may also be used without spring 54 which biases handle 40 and grip 6 in the grip lowered position of FIG. 2A. Also, pulling assemblies constructed using different principles, but still applying a substantially purely axial lift force to the stopper, may be substituted for the cam and handle mechanism disclosed.

What is claimed is:

1. An extractor for removing a stopper from a container, the stopper of the type having an enlarged head which remains outside of the container, the extractor comprising:

a housing, having a side wall terminating in a lower edge, a lower end and an upper end, the upper end having a portion defining an outer housing face;

a grip, disposed for axial movement along a longitudinal axis of the housing, the grip having an inwardly extending lip to at least partially underly the head of the stopper;

a cam, pivotally mounted to the grip at a pivot point and positioned above the upper end of the housing, so that a surface of the cam bears against the outer housing face;

handle means, connected to the cam for pivoting the cam about the pivot point, the pivot point located relative to the cam surface;

the housing having an upper region sized to capture the stopper therein and including an edge guard mounted to the lower edge, the edge guard having an inwardly extending lip configured to mate with the neck of the container surface;

the housing being formed with a cutout sized to allow the enlarged head of the stopper to be inserted laterally through the cutout;

the grip, being contained in the housing, the grip having an interior and a cutout, said interior and cutout shaped and sized to allow the enlarged head of the stopper to be inserted into and housed within the interior of the grip; and biasing means, disposed between the grip and the housing, for biasing the grip to a position at the lower end of the housing wherein the lip on the grip is proximate the lip on the housing so that both the lips fit between the lower edge of the stopper head and a container surface thereby ensuring that the lip on the grip snugly engages the stopper head and the lip on the housing bears upon the container surface so that upon movement of said handle means, the pivot point moves axially upwardly away from the housing face to pull the grip axially within the housing and the stopper therewith axially away from the container and capture the stopper within the housing.

2. An extractor for removing a stopper from a container, the stopper of the type having an enlarged head which remains outside of the container, the extractor comprising:

a housing, having a lower end and an upper end, a portion of the upper end defining an outer housing face, and including a circumferential side wall terminating at a lower edge, the side wall having a cutout sized to allow the enlarged head of the stopper to be inserted laterally through the cutout;

an edge guard, mounted to the lower edge, the edge guard having an inwardly extending lip;

a grip, contained within the housing and disposed for axial movement along the longitudinal axis of the housing, and including a lower, generally cylindrical body with an inwardly extending lip proximate the lower edge of the housing, and an upper, axial extension, including a pair of spaced-apart fingers, the grip having an interior and a cutout in the body shaped and sized to allow the enlarged head of the stopper to be inserted into and housed within the interior of the grip;

manually actuable means for driving the grip axially within the housing from the lower end toward the upper end, the driving means including a cam pivotally mounted to the grip at a pivot point and secured between the fingers of the grip by a pivot pin, a limit pin extending from a side of the cam located to prevent movement of the cam in a direction toward the cutout of the housing when the grip is at the lower end, the cam positioned above the upper end of the housing so that cam surface bears against the outer housing face, and a handle mounted to the cam; and biasing means, disposed between the grip and the housing, for biasing the grip axially toward the lower end of the housing wherein the lip on the housing is proximate the lip on the grip so that when the stopper head is inserted laterally into the grip with the housing lip and housing pressed against the edge of the container and with the lip on the grip engaged under the stopper head, when the handle is moved the cam is rotated causing the grip to rise axially within the housing so that the lip on the grip and the lip on the housing separate thereby pulling the stopper from the container and capturing the stopper in the grip and the housing.

* * * * *